US006736115B1

(12) United States Patent
Leffel et al.

(10) Patent No.: US 6,736,115 B1
(45) Date of Patent: May 18, 2004

(54) AIR INDUCTION SYSTEM COMPRISING THERMAL PUMP FOR HYDROCARBON VAPOR CONTROL

(75) Inventors: Jeffry Marvin Leffel, Wixom, MI (US); Gregory Scott Green, Dearborn, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/376,961

(22) Filed: Feb. 28, 2003

(51) Int. Cl.[7] ..... F02M 33/04
(52) U.S. Cl. ..... 123/519; 220/722
(58) Field of Search ..... 123/518, 519; 220/721, 722

(56) References Cited

U.S. PATENT DOCUMENTS

| | | | | |
|---|---|---|---|---|
| 2,917,110 A | | 12/1959 | Brohl | |
| 3,001,519 A | * | 9/1961 | Dietrich et al. | 123/519 |
| 3,745,984 A | | 7/1973 | King | |
| 4,308,842 A | | 1/1982 | Watanabe et al. | |
| 4,598,686 A | | 7/1986 | Lupoli et al. | |
| 4,700,682 A | | 10/1987 | Ota et al. | |
| 4,700,683 A | | 10/1987 | Uranishi et al. | |
| 4,732,588 A | | 3/1988 | Covert et al. | |
| 4,928,638 A | * | 5/1990 | Overbeck | 123/184.56 |
| 6,446,618 B1 | | 9/2002 | Hill | |
| 2002/0096148 A1 | | 7/2002 | Trumpy et al. | |

FOREIGN PATENT DOCUMENTS

| | | | | |
|---|---|---|---|---|
| JP | 58-128456 | * | 8/1983 | 123/518 |

* cited by examiner

*Primary Examiner*—Andrew M. Dolinar
(74) *Attorney, Agent, or Firm*—Brinks Hofer Gilson & Lione

(57) ABSTRACT

An air induction system for an internal combustion engine comprises an air intake tube and a thermal pump coupled to the air intake tube. The thermal pump comprises a bladder that defines a variable volume gas chamber. Following engine operation, the bladder is inflated to draw air containing hydrocarbon vapors from the air intake tube and prevent their escape into the atmosphere. A preferred mechanism for the thermal pump comprises bimetallic springs that expand and contract in response to changes in temperature to inflate and deflate the bladder.

8 Claims, 3 Drawing Sheets

AIR INDUCTION SYSTEM COMPRISING THERMAL PUMP FOR HYDROCARBON VAPOR CONTROL

TECHNICAL FIELD OF THE INVENTION

This invention relates to an air induction system for supplying air to an internal combustion engine through an air intake tube. More particularly, this invention relates to an air induction system that includes a thermal pump having a variable volume gas chamber operably coupled to the air intake tube and responsive to temperature for drawing hydrocarbon vapors from the air intake tube to prevent escape of hydrocarbon vapors when the engine is not operating.

BACKGROUND OF THE INVENTION

In an automotive vehicle, air is supplied to an internal combustion engine through an air intake tube, referred to as a zip tube, connecting an air cleaner canister and an air intake manifold of the internal combustion engine. When the engine is turned off, residual fuel may produce hydrocarbon vapors in the intake manifold. There is concern that the hydrocarbon vapors may diffuse through the air intake tube and become emitted into the atmosphere. It has been proposed to include a material, such as porous carbon or zeolite, within the air induction system to absorb vapors diffusing from the intake manifold. The absorbed vapors are then desorbed into the air stream when the engine is again operated, whereupon the vapors are consumed in the engine. While various arrangements have been considered, it is desired not to restrict the air flow path through the air intake tube so as to provide the needed air supply during engine operation. As a result, while the hydrocarbon absorbing material may be located to absorb a significant portion of the hydrocarbon vapors, it is nevertheless possible for some vapors to flow through the tube and be emitted into the atmosphere:

In addition to the concern over residual fuel vapors in the intake manifold when the hot engine is turned off, there is also concern about emission of hydrocarbon vapors that may occur when the engine sits idle for an extended period of time and is exposed to variations in ambient temperature. For this purpose, it is common practice to measure hydrocarbon emissions that occur during a diurnal test that cycles the ambient temperature between 65° F. and 105° F. Under these conditions, vapors that were absorbed by the vapor absorbing material may be desorbed into the air flow path and migrate into the atmosphere.

Therefore, a need exists for an air induction system for an internal combustion engine that is effective to draw off air containing hydrocarbon vapors that is attempting to migrate through the air intake tube when the engine is turned off to prevent the vapors from being emitted into the atmosphere and to return the vapors to the air intake manifold when the engine is restarted for combustion in the engine. In addition to capturing residual fuel vapors from the air intake manifold immediately after the hot engine is turned off, it is also desired that the air induction system draw off air from the intake manifold during periods of fluctuating ambient temperature to capture any hydrocarbon vapors therein and so prevent their emission into the atmosphere.

BRIEF SUMMARY OF THE INVENTION

In accordance with this invention, an improved air induction system is provided for an internal combustion engine that includes an air intake tube. The air induction system includes a bladder that defines a variable volume gas chamber. The gas chamber is coupled to the air intake tube for drawing gas into the gas chamber. The volume of the gas chamber varies in response to temperature between a deflated condition at a first, relatively low temperature and an inflated condition at a second, higher temperature. Thus, as the temperature increases, the bladder inflates to draw off gas from the air intake tube that may contain hydrocarbon vapors and thereby prevent the vapors from escaping through the air intake tube into the atmosphere.

In an aspect of this invention, the gas chamber is also variable in response to the operation of the internal combustion engine, regardless of temperature. When the engine is operating, suction produced by the engine to draw air through the air intake tube and the intake manifold also draws air from the gas chamber to deflate the bladder. As a result, when the engine is turned off, the bladder is in a deflated condition despite the elevated temperature due to engine operation. Thereafter, because of the elevated temperature, the gas chamber inflates to draw air from the air intake tube. In this manner, hydrocarbon vapors migrating from the intake manifold through the air intake tube are drawn into the gas chamber and prevented from emission.

In another aspect of this invention, the air induction system includes a hydrocarbon vapor absorbing material, and the gas chamber is operatively coupled to the hydrocarbon vapor absorbing material for expelling gas thereto. Thus, during temperature cycling, the gas chamber inflates as the temperature increases to draw gases from the air induction tube and prevent vapor escape therethrough. Thereafter, as the temperature decreases, the gas chamber deflates to expel gas to the hydrocarbon vapor absorbing material so that the hydrocarbon vapors may be suitably absorbed.

In a preferred embodiment of this invention, the air induction system includes a thermal pump that comprises the bladder and means for inflating and deflating the bladder. This includes at least one element having a variable length responsive to temperature and attached to the bladder for flexing the bladder between the deflated condition and the inflated condition.

In still a further aspect of the preferred embodiment of this invention, the bladder includes at least one panel that flexes to vary the bladder between the deflated condition and the inflated condition. An arm is attached to the panel and includes an outboard portion. A first bimetallic spring is pivotably connected to the outboard portion at a first point and extends in a first direction. A second bimetallic spring is pivotably connected to the outboard portion at a second port outboard to the first point and extends in a second direction generally opposed to the first direction. The first and second bimetallic springs have lengths that vary in response to temperature, preferably so that the springs expand at higher temperatures. As the temperature increases, the springs cooperate to swing the arm between a first position corresponding to the bladder in the deflated condition and a second position corresponding to the bladder in the inflated condition, thereby inflating the bladder and drawing vapor-containing air into the gas chamber. Thereafter, as the temperature decreases, the bimetallic springs cooperate to swing the arm to deflate the bladder and expel the vapor-containing air, for example, for combustion in the engine or absorption by a storage media.

BRIEF DESCRIPTION OF THE DRAWINGS

The present invention will be further illustrated with reference to the accompanying drawings wherein.

DETAILED DESCRIPTION OF THE INVENTION

Figure 1:
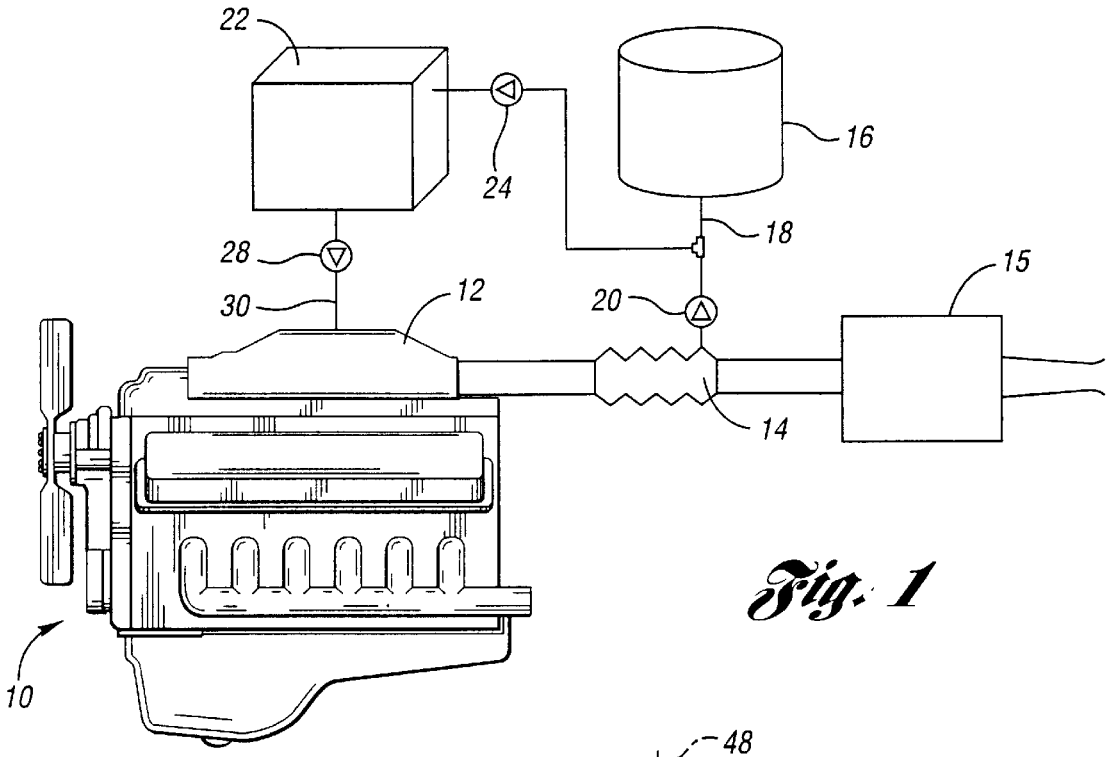
FIG. 1 is a schematic view of an air induction system for an internal combustion engine in accordance with this invention.

In accordance with a preferred embodiment of this invention, FIG. 1 depicts a schematic view of an air induction system for use with an internal combustion engine 10 onboard an automotive vehicle. The air induction system includes an air intake tube 14 for drawing air from an air cleaner canister 15 to an intake manifold 12 of engine 10 during engine operation. When the engine is not operating, there is concern about hydrocarbon vapors derived from residual fuel in engine 10 that tends to migrate from intake manifold 12 through air intake tube 14 to air cleaner canister 15 and may become emitted into the atmosphere. In accordance with this invention, a thermal pump 16 is operatively connected to air intake tube 14 through a tube 18. Tube 18 includes a check valve 20 that opens to allow air to be drawn into thermal pump 16, but closes to prevent air reverse flow from the thermal pump into the air intake tube. In this embodiment, the air induction system also includes a vapor absorption canister 22 that contains a hydrocarbon vapor absorbing material, such as porous carbon or zeolite. Thermal pump 16 is connected to vapor absorption canister 22 through a T-connection in tube 18 and includes a check valve 24 that opens to allow gas flow from thermal pump 16 into vapor absorption canister 22 and closes to prevent reverse gas flow into thermal pump 16. Canister 22 is connected to intake manifold 12 through a conduit 30 that includes a check valve 28 that allows vapors to be purged from canister 22 into intake manifold 12, but closes to prevent gas flow from the intake manifold directly into the vapor absorption canister. The connection of thermal pump 16 to air intake tube 14 allows unobstructed air flow through the intake tube from the air cleaner canister 15 to intake manifold 12 during engine operation. Check valves 20 and 24 cooperate to allow gas flow from intake tube 14 into thermal pump 16 and to allow gas flow from thermal pump 16 into vapor absorption canister 22, while preventing gas flow back Into air intake tube 14. This allows hydrocarbon vapors to be drawn from intake 14 by the thermal pump 16 and supplied to canister 22 for absorption therein. During engine operation, check valves 20, 24 and 28 allow air flow from air intake tube 14 through vapor absorption canister 22 and into air intake manifold 12. This air flow through vapor absorption canister 22 allows vapors that are absorbed by the vapor absorbing material to be desorbed and drawn into intake manifold 12 for combustion within the engine.

Figure 2:
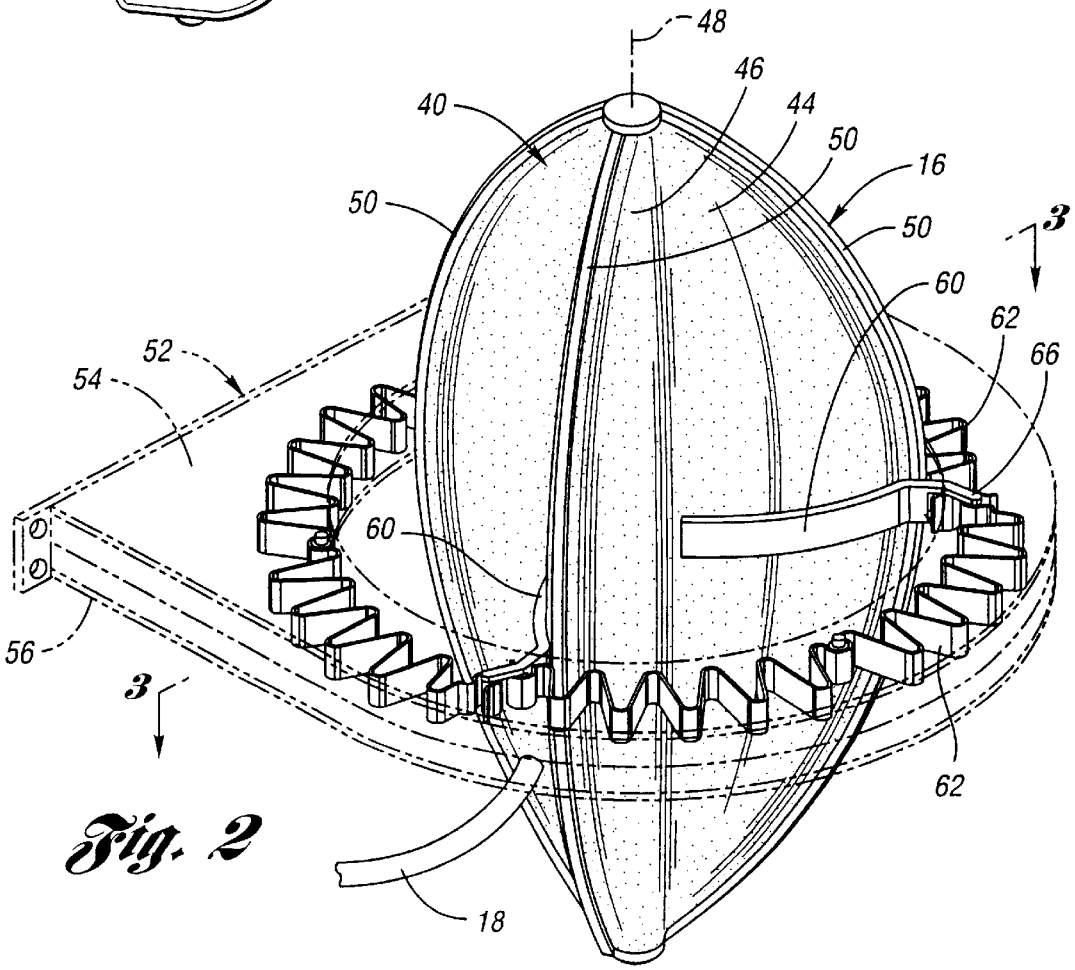
FIG. 2 is a perspective view of a thermal pump for use in the air induction system of FIG. 1.
Figure 3:
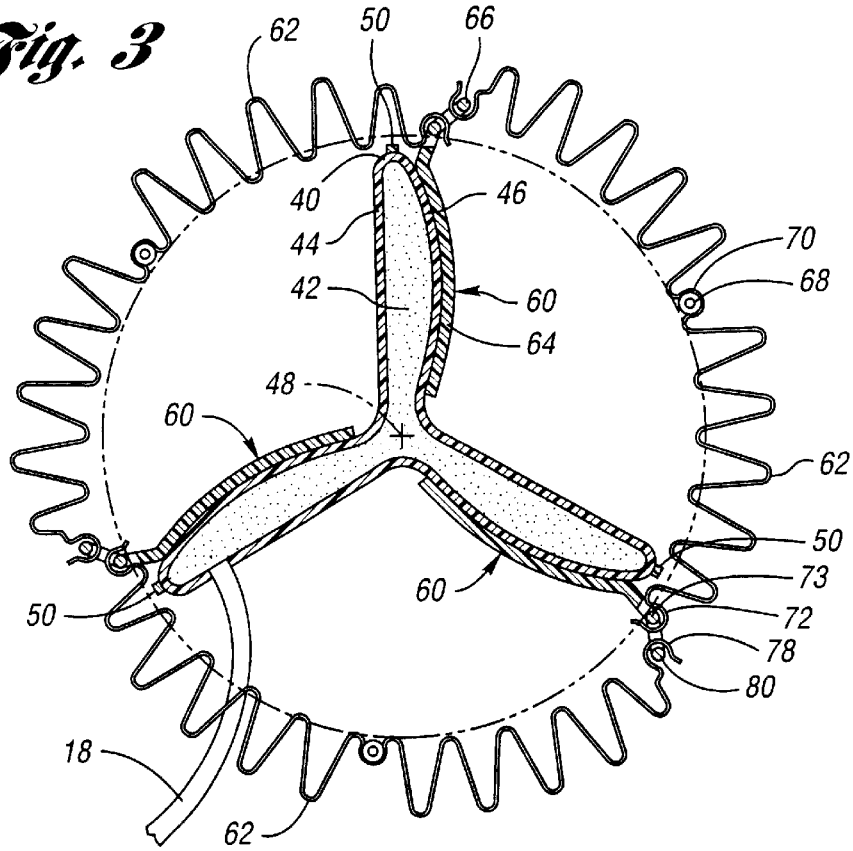
FIG. 3 is across-sectional view of the thermal pump in FIG. 2, taken along lines 3—3, showing the thermal pump in a deflated condition.
Figure 4:
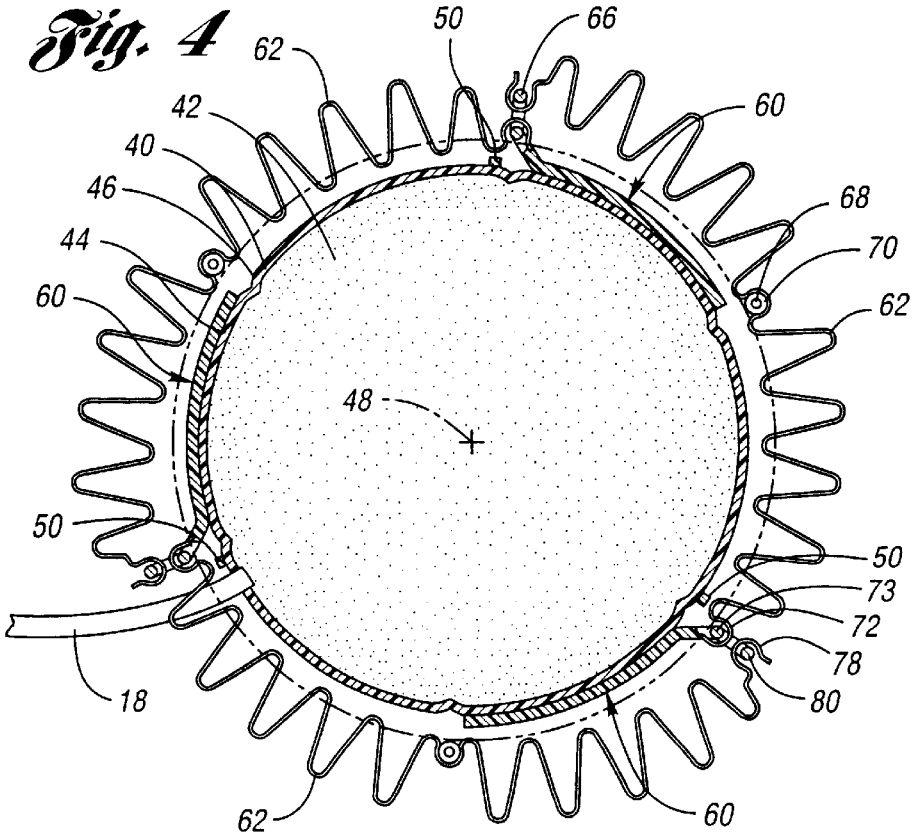
FIG. 4 is a cross-sectional view of the thermal pump similar to FIG. 3 and showing the thermal pump in an inflated condition.

Referring to FIGS. 2 through 4, there is depicted a thermal pump 16 in accordance with a preferred embodiment of this invention. Thermal pump 16 comprises a bladder 40 formed of an elastomeric material, similar to a football bladder. Bladder 40 defines a gas chamber 42 and comprises first panels 44 and second panels 46 that are arranged in opposed pairs. Panels 44 and 46 flex about an axis 48 to vary the volume of gas chamber between the bladder in a deflated condition shown in FIG. 3 and the bladder in an inflated condition shown in FIG. 4. A tube 18 is attached to one of the panels connected to the air intake tube of the air induction system and to a vapor absorption canister, as described with reference to FIG. 1. Ribs 50 reinforce the bladder along outboard vertices between panels 44 and 46 to prevent collapse of bladder 40 along axis 48. In this manner, bladder 40 deflates by preferentially collapsing panels 44 and 46 together in the opposed pairs, with the inboard vertices being drawn generally radially toward axis 48. In the depicted embodiment, bladder 40 comprises three pairs of panels 44 and 46, but may be suitably carried out utilizing the bladder having two or more opposed pairs.

Bladder 40 is mounted in a mounting bracket 52 that includes plates 54 and 56 that are axially spaced. In accordance with this preferred embodiment, thermal pump 16 includes a mechanism for inflating and deflating bladder 40 which includes arms 60 and bimetallic springs 62. Each arm 60 includes an attachment portion 64 that is attached to a first panel 44 of bladder 40 and an outboard portion 66. Springs 62 are attached to mounting bracket 52 at pins 68 that extend between plates 54 and 56 with a grommet 70 between the spring and the pin for stress relief. Plates 54 and 56 are axially spaced to provide clearance for the bimetallic springs within the mounting bracket. In this manner, pins 68 provide a fixed point about which springs 62 expand or contract in response to variations in temperature.

Each spring 62 includes a first end 72 that is pivotably connected to a cylindrical pivot 73 integrally formed in outboard portion 66 of arm 60. Each spring 62 also includes a second end 78 that is pivotably connected to a second cylindrical pivot 80 of arm 60. Grommets may be provided between spring ends and pivots to facilitate pivoting of the spring end about the pivot. Pivot 73 is located at a first distance from bladder 40, whereas pivot 80 is a second point outboard from the first point of pivot 73. Clearances are provided about pivot 72 and 80 to accommodate the ends of the springs during operation of the mechanism.

Bimetallic spring 62 is preferably formed of serpentine dual metal layers having different coefficients of thermal expansion that cause the length to expand or contract in response to changes in temperature. By way of an example, a suitable spring comprises a first, relatively high expansion layer composed of an iron alloy containing about 36 percent nickel and a second, relatively low expansion layer composed of an iron alloy containing about 22 percent nickel and 3 percent chromium. The springs 62 are attached to each arm 60 at an outboard portion 66 such that the arm is pivotably connected to one spring at a first point (pivot 73) so that the spring extends in a first direction, and is also connected to a second spring at a second point (pivot 80) that is outboard from the first point and extends in a second direction generally opposite to the first direction. Referring in particular to FIG. 3, there is depicted thermal pump 16 with bladder 40 in a deflated condition, which preferably corresponds to a temperature of about 65° F. The orientation of arm 60 is determined by the length of spring 62 between the fixed point defined by pin 68 and the end 72 connected to pivot 73, and also by the length of the adjacent spring between the fixed pin 68 and the end 78 connected to the outboard pivot 80. In this deflated condition, the volume of gas chamber 42 is at a minimum. As the temperature increases, the lengths of springs 62 about fixed points 68 expand and causes the arms 60 to swing into the position shown in FIG. 4. As bladder 40 inflates, air is drawn into the gas chamber 42 through tube 18. In the preferred embodiment, a fully inflated condition occurs at a temperature of about 105° F. and maximizes the volume of gas chamber 42. As the temperature decreases, the springs contract about fixed point 68 to return the orientation of arm 60 to the deflated condition shown in FIG. 3 and to force air out from gas chamber 42.

Figure 5:
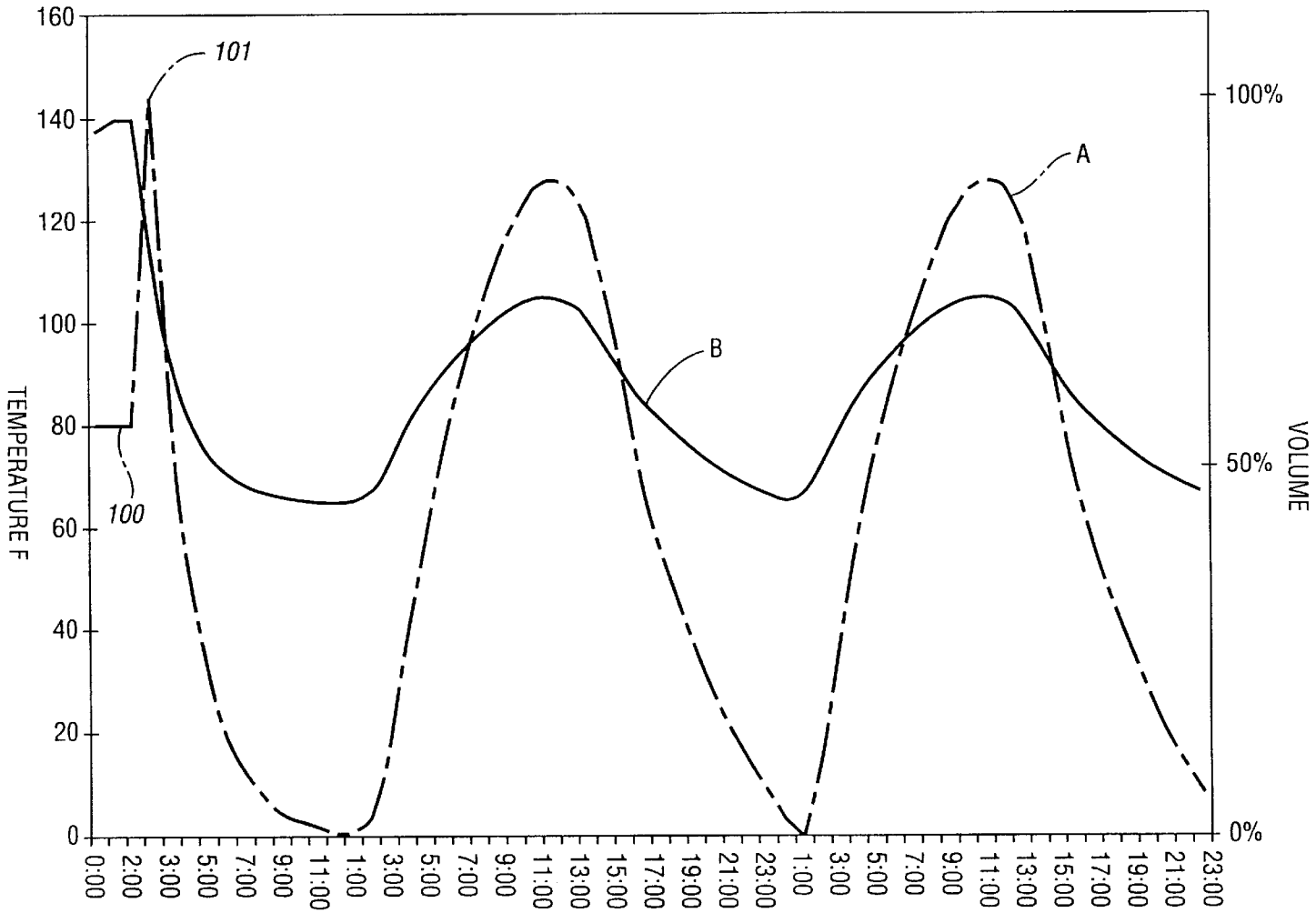
FIG. 5 is a graph showing fluctuations in volume of the thermal pump and temperature over a period of time.

The operation of thermal pump 16 in the air induction system to control hydrocarbon vapor emission is described with reference to FIG. 5 which shows a curve A of the volume of chamber 42 with reference to the right axis and a curve B showing temperature with reference to the left axis, both as a function of time. When the engine is operating, air is drawn through intake tube 14 from air cleaner 15 to intake manifold 12. Also, air is drawn through vapor absorption canister 22 into intake manifold 12. As a result of heat radiated by the engine during operation, the temperature of thermal pump 16 increases and causes bimetallic springs 62 to expand and swing arms 60 to inflate bladder 40. However, the intake manifold draws air through canister 22 and also draws air through tube 18 from air chamber 42 and partially deflates bladder 40. That is, the suction applied to bladder 40 deflates the bladder and applies a mechanical force that contracts the springs, countering the tendency of the springs to thermally expand. This is indicated by section 100 of curve A in FIG. 5, which shows the volume of air chamber 42 at about 50% full capacity when the temperature is high, at about 140° F. When the engine is turned off, the suction applied to air chamber 42 is discontinued, and bladder 40 inflates as a result of the expanded lengths of springs 62 which draws air flow from air intake tube 14 into air chamber 42. The rate of air flow into the air chamber is regulated by the flow of air through check valve 20 and more particularly by the size of the orifice provided therein. In this embodiment, the orifice is sized to draw air slowly into air chamber 42 over a period of between about one and two hours, during which the engine is cooling down but remains at an elevated temperature. At the elevated temperature, residual fuel in the engine may form hydrocarbon vapors within the intake manifold that may migrate through the air intake tube. However, the hydrocarbon vapors are drawn with the air through tube 18 into chamber 42. Thus, the vapors are not permitted to migrate to the air cleaner or escape into the atmosphere.

As the engine and thermal pump cool, and air is drawn into the bladder, the gas chamber reaches a maximum capacity indicated at 101. In this example, maximum capacity occurs at about 105° F. Thereafter, as the engine and the thermal pump further cools, springs 62 tend to contract and swing arms 60 to deflate bladder 40 and decrease the volume of air chamber 42. As bladder 40 deflates, air is expelled from air chamber 42 into tube 18. Because of check valve 20, the air is directed to flow into hydrocarbon absorption canister 22, whereupon the vapors are absorbed by the material therein.

Upon prolonged sitting, the engine and the thermal pump reach ambient temperature. As the ambient temperature increases, the springs 62 tend to expand and to swing arms 60 to expand the gas chamber 42. Check valve 24 closes, and check valve 20 opens to preferentially draw air from air tube 14 into air chamber 42. Any residual hydrocarbon vapors within intake manifold 12 that may migrate through air tube 14 are thus drawn into air chamber 42 and not permitted to escape through air cleaner canister 15. As the engine sits idle and the ambient temperature decreases, springs 62 contract to swing arms 60 to deflate bladder 40 and to expel air from air chamber 42, whereupon check valve 20 closes and check valve 24 opens to direct the expelled air into vapor absorption canister 22. This cyclic inflation and deflation of bladder 40 in response to cycling of the ambient temperature continues for so long as the engine remains idle, with springs 62 expanding and contracting in response to changes in the ambient temperature to inflate and deflate the bladder and to draw vapor-containing air from the air intake tube and pump it into the vapor absorption canister, thereby preventing the escape of vapors into the atmosphere.

When the engine is again restarted, the flow of air through the vapor absorption canister causes the absorbed hydrocarbon compound to desorb and supplies the nascent vapors to the intake manifold for combustion within the engine.

Therefore, this invention provides an air induction system that prevents the escape of hydrocarbon vapors from the intake manifold of the internal combustion engine through the intake air tube under two conditions of concern. First, the air induction system prevents escape of vapors during a period immediately following operation of the engine before the engine has cooled to ambient. In addition, the air induction system prevents escape of vapors despite fluctuations in temperature during prolonged periods of inactivity. The system includes a bladder that expands and draws the vapors from the air intake tube.

The bladder also deflates to pump the vapors into a vapor absorption canister for storage until the vapors can be appropriately consumed in the engine. Deflation of the bladder occurs during periods of low ambient temperature when the risk of vapor emission is minimal and purges air from the bladder in preparation for next period of rising temperature, when the potential of vapor emission increases. In accordance with the preferred embodiment, the bladder is part of a thermal pump that includes bimetallic springs that operate the pump in response to changes in ambient temperature. Thus, the thermal pump does not require power from the engine or from the electrical system of the automotive vehicle.

While this invention has been described in terms of certain embodiments thereof, it is not intended to be so limited, but rather only to the extent set forth in the claims that follow.

We claim:

1. An air induction system of an internal combustion engine comprising an air intake tube, said air induction system comprising:

a bladder defining a variable volume gas chamber coupled to the air intake tube for drawing gas into the variable volume gas chamber, said variable volume gas chamber being variable in response to temperature between a deflated condition at a first temperature and an inflated condition at a second temperature greater than the first temperature.

2. An air induction system in accordance with claim 1 wherein the variable volume gas chamber is variable at said second temperature between said inflated condition when said internal combustion engine is not operating and a deflated condition when said internal combustion engine is operating.

3. An air induction system in accordance with claim 1 wherein the air induction system comprises a thermal pump, and wherein the thermal pump includes said bladder and means responsive to temperature for inflating and deflating said bladder.

4. An air induction system in accordance with claim 1 wherein the air induction system comprises a hydrocarbon vapor absorbing material and wherein the variable volume gas chamber is coupled to the hydrocarbon vapor absorbing material for expelling gas thereto.

5. An air induction system of an internal combustion engine comprising an air intake tube and a thermal pump, said thermal pump comprising:

a bladder defining a variable volume gas chamber and coupled to the air intake tube for drawing gas into the variable volume gas chamber, said bladder being expandable between a deflated condition and an inflated condition; and means for inflating and deflating said bladder, said means comprising at least one element having a variable length responsive to temperature and attached to the bladder for moving the bladder between the deflated condition and the inflated condition.

6. An air induction system in accordance with claim 5 wherein the element is a bimetallic spring.

7. An air induction system of an internal combustion engine comprising an air intake tube, a vapor storage chamber comprising a hydrocarbon absorbing material, and a thermal pump, said thermal pump comprising;

a bladder defining a variable volume gas chamber and coupled to the air intake tube for drawing gas therefrom and to the vapor storage chamber for expelling gas thereto, said bladder comprising at least one panel that flexes to vary said bladder between a deflated condition and an inflated condition;

an arm attached to said first panel and including an outboard portion;

a first bimetallic spring pivotally connected to said outboard portion at a first point and extending in a first direction, said first bimetallic spring having thermally variable length; and a second bimetallic spring pivotally connected to the outboard portion at a second point outboard relative to said first point and extending in a second direction generally opposed to the first direction, said second bimetallic spring having a thermally variable length, whereby said first bimetallic spring and said second bimetallic spring cooperate to swing said arm between a first position corresponding to the bladder in the deflated condition and a second position corresponding to the bladder in the inflated condition.

8. An air induction system in accordance with claim 7 wherein the thermal pump comprises a plurality of said arms and a plurality of bimetallic springs interconnecting the arms, whereby each bimetallic spring serves as the first bimetallic spring for one arm and the second bimetallic spring for another arm.

* * * * *